US007740292B1

(12) United States Patent
Fattori et al.

(10) Patent No.: US 7,740,292 B1
(45) Date of Patent: Jun. 22, 2010

(54) MECHANICAL TAMPER-EVIDENT HIGH SECURITY SEAL AND METHOD OF USE TO SECURE A CARGO CONTAINER

(76) Inventors: Lazzaro A. Fattori, 3399 SE. Cambridge Dr., Stuart, FL (US) 34997; Paul L. Fattori, 111 Hawthorn Dr., Jupiter, FL (US) 33458

( * ) Notice: Subject to any disclaimer, the term of this patent is extended or adjusted under 35 U.S.C. 154(b) by 546 days.

(21) Appl. No.: 11/525,468

(22) Filed: Sep. 22, 2006

(51) Int. Cl.
*B65D 55/00* (2006.01)

(52) U.S. Cl. ..... 292/307 R; 292/327

(58) Field of Classification Search ..... 292/327, 292/308, 340, 347, 320, 307 R, 307 A, 307 B, 292/217–218; 24/136 A; 40/662–675, 630, 40/638

See application file for complete search history.

(56) References Cited

U.S. PATENT DOCUMENTS 1,079,839 A * 11/1913 Ciernia ..... 292/327
3,680,236 A * 8/1972 Deal et al. ..... 40/630
4,802,700 A * 2/1989 Stevenson et al. ..... 292/327
5,120,097 A * 6/1992 Fattori et al. ..... 292/318
5,125,700 A 6/1992 Fattori et al.
5,551,729 A * 9/1996 Morgan ..... 283/94
5,791,702 A * 8/1998 Liroff ..... 292/307 R
6,888,241 B1 * 5/2005 Korn et al. ..... 257/728
6,962,376 B2 * 11/2005 Palzkill et al. ..... 292/327
7,042,354 B2 * 5/2006 Auerbach et al. ..... 340/539.31
7,336,170 B2 * 2/2008 Auerbach et al. ..... 340/539.31
7,438,334 B2 * 10/2008 Terry et al. ..... 292/327
2004/0021312 A1 * 2/2004 Dietz et al. ..... 283/81
2006/0086013 A1 * 4/2006 Stegman et al. ..... 40/27.5
2008/0066359 A1 * 3/2008 Littrell et al. ..... 40/665

* cited by examiner

*Primary Examiner*—Peter M Cuomo
*Assistant Examiner*—Kristina R Fulton
(74) *Attorney, Agent, or Firm*—Gold & Rizvi, P.A.; Glenn E. Gold; H. John Rizvi

(57) ABSTRACT

A mechanical tamper evident security seal for sealing a cargo container door includes a metallic pin having a head at an upper end and circumferential indents at a second end. An upper banner includes a portion non-removably encasing the head of the metallic pin. The banner includes first identifying indicia unique to a particular one of a plurality of like mechanical seals. A lock receptacle receives the second end of the metallic pin therein and includes a lock housing retaining at least two locks therein. A first of the locks engaging a first of the circumferential indents and a second of the locks simultaneously engages a second of the circumferential indents. Any attempt to withdraw the metallic pin results in visually identifiable destruction of the seal. A lower banner extending from the lock receptacle includes second unalterable identifying indicia identical to the first identifying indicia. The seal is one element of a security seal tamper-evidencing kit providing a multi-layered approach to securing a cargo container.

25 Claims, 5 Drawing Sheets

MECHANICAL TAMPER-EVIDENT HIGH SECURITY SEAL AND METHOD OF USE TO SECURE A CARGO CONTAINER

BACKGROUND OF THE INVENTION

1. Field of the Invention

The present invention relates to security seals in general and more particularly to a tamper-evident seal and associated components of a system for securing cargo-shipping containers.

2. Discussion of the Related Art

Unauthorized access to the interior of cargo shipping containers is a well-documented problem in the transportation industry. Such unauthorized access often leads to the theft of container contents, resulting in substantial financial losses for individuals, businesses and others involved in the transportation of goods. In addition to the theft of goods, such unauthorized access often leads to use of containers for the smuggling of contraband. Contraband smuggling has long been a well-documented problem in the transportation industry. Smugglers work very hard to enter containers on cargo vessels, airplanes and the like to conceal the illegal transportation of contraband. Not only does the smuggling of contraband create serious and devastating social problems, the transportation companies face significant government-imposed penalties including heavy fines and the confiscation of equipment in the event that the contraband is discovered.

As the transportation industry transitioned into the twenty-first century, terrorism has become an ever-increasing concern. With recent terrorist attacks occurring within the country, customs and immigration controls are becoming ever more stringent. Miscellaneous contraband is not the only subject of illegal import within the transportation industry. Weapons of all kinds including nuclear, biological, and chemical, collectively known as weapons of mass destruction (WMD), are now feared to be the subject of terrorist efforts. Clearly, shipping container security is a highly visible aspect of the current war on terrorism.

Seals of many types, including tamper-evident seals, have been designed for, or used in connection with, transportation containers. Unfortunately, thieves, smugglers and would-be terrorists have become ever more proficient and sophisticated when it comes to breaching conventional cargo container seals. Furthermore, security seals which intend to evidence tampering, and perform little function as a true lock, are often compromised by expert craftsmen who can break such seals and replace or prepare the broken parts in a manner that will avoid detection. Another common practice is the substitution of seals, including the substitution of one ISO-compliant seal with another ISO-compliant seal. The seals are broken and then substituted or re-sealed in such a manner that visual observation alone will not readily reveal that the container has been tampered with.

The dangers that such undiscovered tampering presents, has led government agencies responsible for securing our borders against illegal importation to issue ever more stringent requirements to ensure the integrity of a sealed container. Some initial security seals attempting to overcome smuggler's efforts to place contraband in shipping containers are disclosed in U.S. Pat. No. 5,120,097 and U.S. Pat. No. 5,125,700. However, overcoming these seals can be the subject of a smuggler's efforts requiring additional security measures. Some of these requirements include time limitations on providing the government agencies shipping data within specified timelines, metal bolt to metal lock type seals, and additional tamper-evident features.

Thus what is needed is an improved security seal and method for sealing shipping containers to prevent unauthorized tampering with shipping containers.

SUMMARY OF THE INVENTION

One aspect of the present invention is a mechanical security seal for sealing the hasp of a shipping container door having a pair of aligned openings adapted to receive a lock. The mechanical security seal comprises a metallic pin having a head at an upper end and a plurality of circumferential indents at a second end. An upper banner includes a portion non-removably encasing, and integrally molded to, the head of the metallic pin. The banner includes a first identifying indicia formed thereon wherein the first indicia is unique to a particular one of a plurality of like mechanical seals. Furthermore, the first indicia replicate corresponding second indicia provided on a lower banner of the seal. A lock receptacle receives the second end of the metallic pin therein and includes a lock housing retaining at least two locking levels therein. A first one of the locks engages a first of the circumferential indents and a second one of the locks simultaneously engages a second of the circumferential indents. A first one of the locks comprises a lock structure retained in the lock receptacle wherein the lock structure has an aperture therethrough defined by a cannular surface therein receiving the second end of the metallic pin. The aperture is marginally larger than a diameter of the metallic pin. The cannular surface further defines a circumferential recess therein and having an upper frusto-conical surface such that a lower diameter of the frusto-conical surface is greater than an upper diameter thereof. A radially expansive locking ring is disposed in the circumferential recess and has a relaxed diameter less than said metallic pin diameter. The locking ring becomes engaged in one of the metallic pin circumferential indents when the metallic pin is received in the lock receptacle such that an outer diameter of the locking ring engaged in the metallic pin circumferential indent is greater than the aperture diameter. A second one of the locks comprises a plurality of inwardly tapering resilient fingers. As the first circumferential indent engages the locking ring of the first lock, the second circumferential indent simultaneously engages the resilient fingers of the second lock. Any attempt to withdraw the metallic pin results in the frusto-conical surface forcing the locking ring against the metallic pin circumferential indent, as well as second indent permanently deforming the distal ends of the resilient fingers, thereby preventing withdrawal of the metallic pin from the lock receptacle without visually evident destruction of the seal.

Another aspect of the present invention is a security seal kit for sealing a shipping container door, the kit including a mechanical security seal further comprising a metallic pin having a head at an upper end and non-removably encased in an upper banner, the upper banner further having first identifying indicia formed thereon. The indicia are unique to a particular one of a plurality of like mechanical seals. In other words, seal identifiers, such as a series of numeric or alphanumeric indicia, are never repeated. The metallic pin has a plurality of circumferential indents at a second end thereof. A lock receptacle for receiving the second end of the metallic pin therein includes a lock housing retaining at least two locks therein. A first of the locks is provided for non-removable engagement of a first of the circumferential indents, and a second of the locks for non-removable engagement of a second of the circumferential indents. The lock receptacle further includes a substantially transparent lower banner extending therefrom and having encapsulated therein second identifying indicia identical to the first identifying indicia on the upper banner. The kit also includes a first security adhesive label incorporating at least one tamper-evident feature and also has a visual depiction of the mechanical security seal printed thereon, the visual depiction including the unique identifying indicia. A second adhesive label includes a visual depiction of the mechanical security seal printed thereon, the visual depiction including the unique identifying indicia. Also included is an electronic memory device adapted for electronic connection with a data processing device and having electronically stored therein a digital file of the visual depiction of the mechanical security seal including the unique identifying indicia.

Yet another aspect of the present invention is a method of security sealing a container for shipping, the method comprising a series of steps. A uniquely identified mechanical security seal is associated with a uniquely identified container. Next, a mechanical security seal metallic pin having an upper banner with unique identifying indicia formed thereon is inserted through a pair of aligned openings on a door closure structure of the container, such as a hasp, and is adapted to receive a lock such that the door cannot be opened without removing the metallic pin. A locking receptacle having a plurality of locks therein and a lower banner with identical identifying indicia are then sleeved over the metallic pin until all locks in the receptacle engage the metallic pin. A first security adhesive label is adhesively applied to an area of a doorframe interface area of the container such that opening the door will fracture the first security adhesive label. The first security adhesive label includes at least one tamper-evident feature as well as a visual depiction of the mechanical security seal printed thereon, wherein the visual depiction includes the unique identifying indicia. A second adhesive label is adhesively applied to a shipping document separate from the container, wherein the shipping document includes a unique identifier of the container and the adhesive label includes a visual depiction of the mechanical security seal printed thereon including a visual depiction of the unique identifying indicia.

These and other advantages of the invention will be further understood and appreciated by those skilled in the art by reference to the following written specification, claims and appended drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 4:
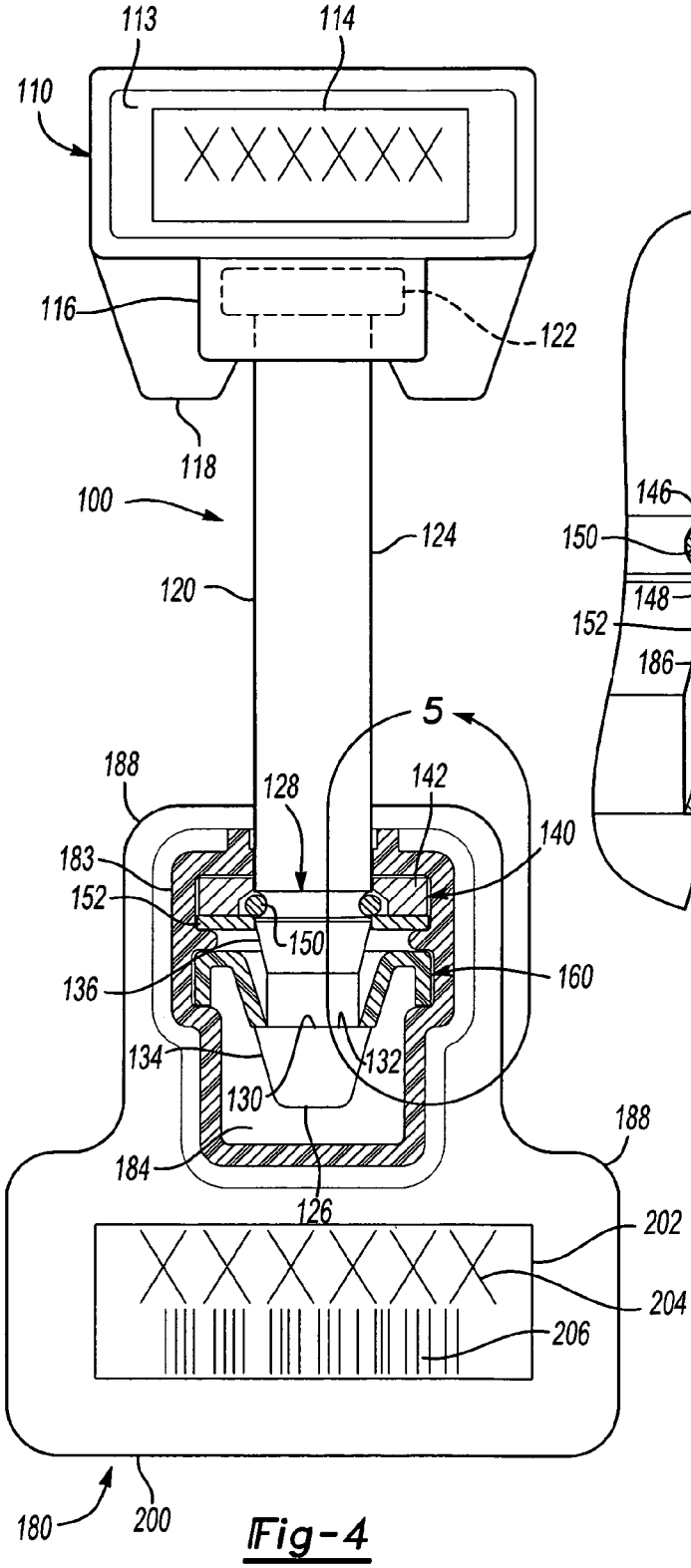
FIG. 4 is a partial cross-sectional front elevation view of the mechanical security seal.

For purposes of description herein, the terms "upper", "lower", "left", "rear", "right", "front", "vertical", "horizontal", and derivatives thereof shall relate to the invention as oriented in FIG. 4. However, one will understand that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
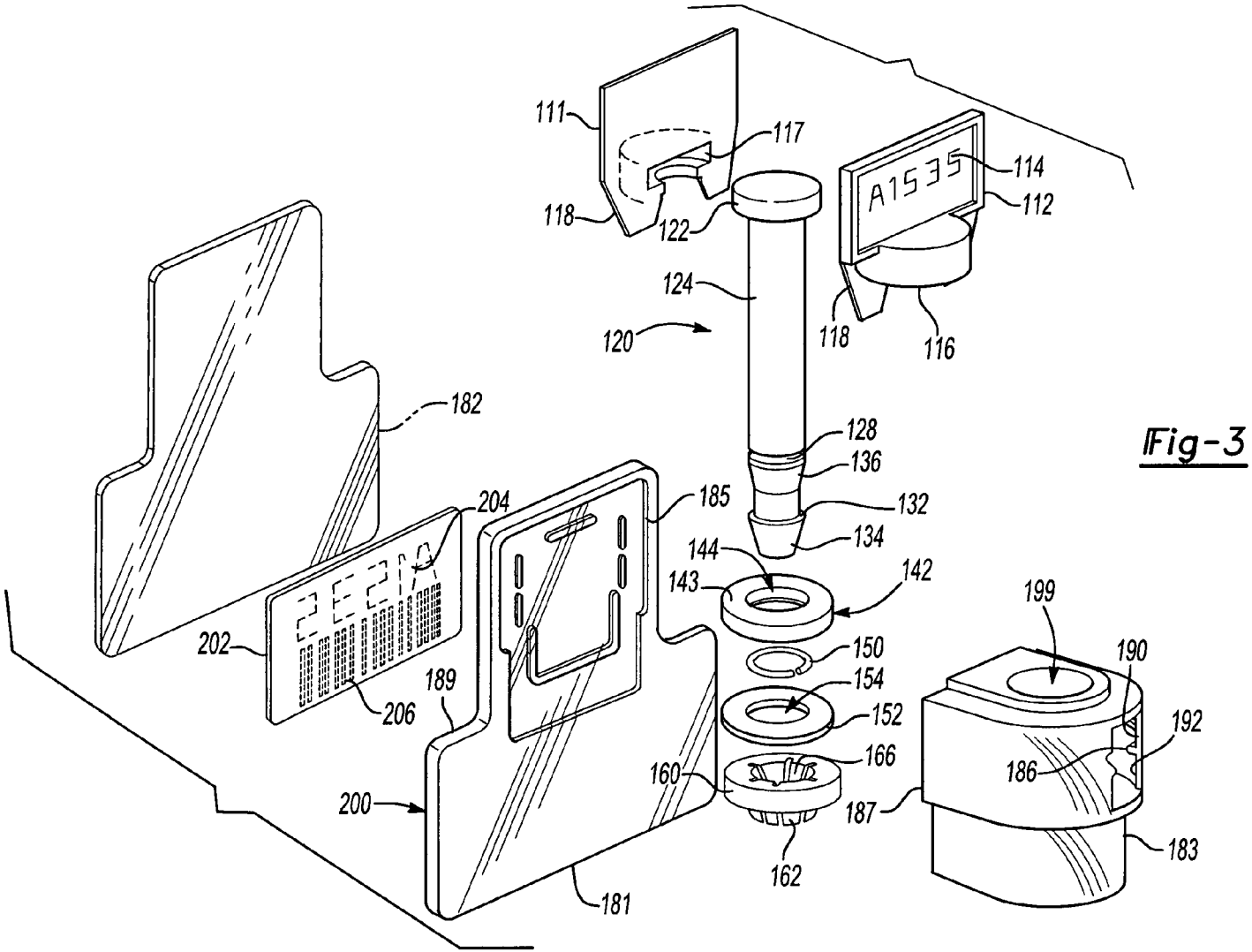
FIG. 3 is an exploded perspective view of the mechanical security seal illustrating its various elements.
Figure 5:
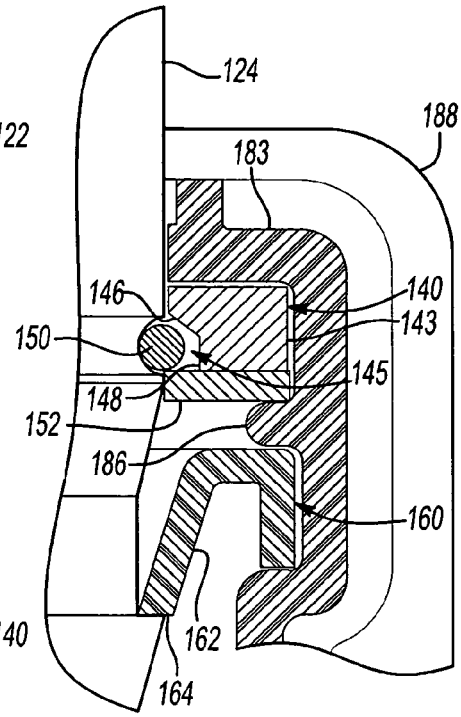
FIG. 5 is an enlarged partial cross section view of the lock housing indicated by arrow 5, FIG. 4.
Figure 6:
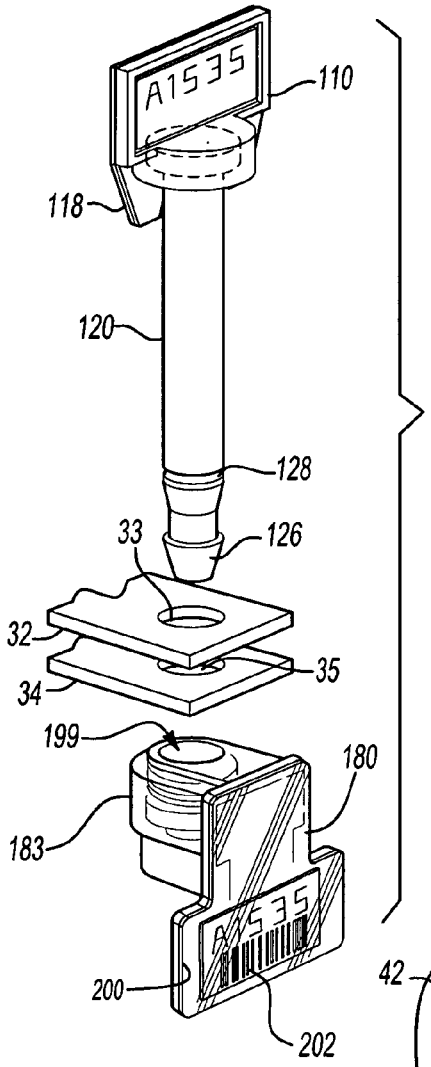
FIG. 6 is a perspective view of the mechanical security seal prior to installation on a shipping container.
Figure 7:
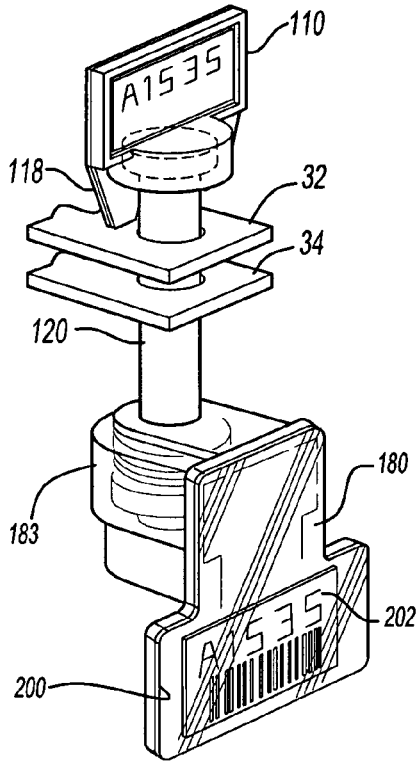
FIG. 7 is a perspective view of the mechanical security seal after installation on the shipping container.

Turning to the drawings, and initially to FIGS. 3-5, the drawings illustrate a mechanical security seal 100, which is one of the preferred embodiments of the present invention and illustrates its various components.

As illustrated in FIGS. 3-5, mechanical security seal 100 has a metallic pin 120 preferably fabricated from steel. Pin 120 has a head 122 at an upper end thereof, a stem 124, and a plurality of circumferential indents 128, 130 at a lower end 126. A first tapered surface 136 is located below first circumferential indent 128 and a second tapered surface 134 is located below second circumferential indent 130. Second circumferential indent 130 is at least partially defined by shoulder 132 immediately above second tapered surface 134.

An upper banner 110 has a head encasement 116 defining a head cavity 117 for receiving head 122 of metallic pin 120. Upper banner 110, shown separated into halves 111 and 112 for illustrative purposes only, is integrally molded from a thermoplastic, such as polycarbonate, or any other suitable polymer, such that head 122 cannot be removed therefrom without visibly destroying unitary upper banner 110. Upper banner 110 also includes an identification field 113 on which can be molded, or engraved as by laser engraving, unique identifying indicia 114 such as an alphanumeric serial number. As an additional tamper-evident feature, upper banner 110 can include fins 118 depending from field area 113 and on either side of head encasement 116. Fins 118 depend below head 122. In the event that a prying device is used in an attempt to remove security seal 100, fins 118 would show evidence of crushing or deformation and thus indicate an attempt to tamper with security seal 100.

A locking receptacle, shown generally as reference numeral 180, has a locking body 188 formed from a substantially transparent thermoplastic such as polycarbonate. Locking body 188 in one form comprises a separately molded lock housing 183 and a lower banner 200. Lower banner 200 is constructed of a molded banner plate 181, 182, which has a recess 185 formed therein. Recess 185 is configured to receive therein a back rim 187 of lock housing 183. Molded banner plate 181, 182 is, in turn, ultrasonically welded to back rim 187 of lock housing 183. Lower banner 200 depends below lock housing 183 and has unique identifying indicia 204 embedded therein. Unique identifying indicia 204 are identical in content, such as an alphanumeric serial number, to identifying indicia 114 on upper banner 110. Banner 200 can also include a machine-readable bar code 206 corresponding to unique identifying indicia 204. In one embodiment, indicia 204 and bar code 206 are pre-printed on one or both sides of a thin film 202, which is positioned upon an interior face of molded banner plate 182. Subsequently, overmolded layer 181 is integrally formed thereon, resulting in the encapsulation, or embedding, of indicia 204 and bar code 206 within unitary lower banner 200. Alternatively, in another embodiment, indicia 204 and bar code could be engraved or otherwise formed on the interior face of molded banner plate 182 with over molded layer 182 applied thereover. The formation of a unitary banner is a significant aspect of the invention. Since body 188 is formed of transparent thermoplastic, the embedded indicia 204 and bar code 206 remain readable after assembly. Any attempt to remove indicia 204 and bar code 206 would result in total destruction of lower banner 200 and of indicia 204 and bar code 206, thus indicating that security seal 100 had been tampered with.

Lock housing 183 defines at an upper end of a lock receptacle aperture 199 having a diameter marginally greater than the diameter of stem 124 of metallic pin 120. Lock housing 183 further defines a lock cavity 184, which is divided into a first lock chamber 190 and a second lock chamber 192. First lock 140 is supported in first lock chamber 190, and second lock 160 is supported in second lock chamber 192. Locks 140 and 160 are supported in a vertically spaced relationship such that lock 140 engages first circumferential indent on metallic pin 120 simultaneously with lock 160 engaging second circumferential indent 130 when second end 126 of metallic pin 120 is received in locking receptacle 180.

First lock 140 comprises a lock structure 142, one embodiment of which is a support plate 152 having a central aperture 154 therethrough abutted to a bottom surface of a resistance plate 143. Resistance plate 143 has a central aperture 144 therethrough. Apertures 144 and 154 are marginally greater than the diameter of stem 124 of metallic pin 120. The bottom surface of resistance plate 143 has a tapered counterbore extending upwardly and partially into aperture 144 such that an upper surface of the counterbore has a frusto-conical surface 146 with a lower diameter greater than an upper diameter thereof. The counterbore also has a lower cannular wall 148 having a diameter equal to the lower diameter of the frusto-conical surface 146. The abutment of support plate 152 to the bottom surface of resistance plate 143 defines, in combination with frusto-conical surface 146 and cannular surface 148, a circumferential groove 145 in lock structure 142.

A radially expansive lock ring 150 is at least partially received in circumferential groove 145. Lock ring 150 has a relaxed diameter less than the diameter of stem 124 of metallic pin 120 and preferably less than an inner diameter of first circumferential indent 128 defined in stem 124 of metallic pin 120. Circumferential groove 145 in lock structure 140 has sufficient radial depth to receive the entire cross-sectional thickness of lock ring 150. Support plate 152, resistance plate 143, and radially expansive ring 150 are all formed of metal such that the combination with metallic pin 120 results in a metal-to-metal lock.

Second lock 160 is formed as a split finger-locking ring and can be molded from a thermoplastic. Lock 160 includes a plurality of resilient fingers 162 in a circular arrangement and extending downward and inwardly wherein distal ends 164 of resilient fingers 162 define a central opening having a diameter smaller than the diameter of stem 124 of metallic pin 120.

In use, as second end 126 of metallic pin 120 is inserted in locking receptacle 180 through aperture 199, second tapered surface 134 gradually expands lock ring 150 into circumferential groove 145 and allows second end 126 of pin 120 to pass lock ring 150. As metallic pin continues its insertion in locking receptacle 180, second tapered surface 134 contacts resilient fingers 162 of lock 160 and gradually displaces distal ends 164 of resilient fingers 162 outward. Simultaneously, first tapered surface 136 gradually expands lock ring 150 into circumferential groove 145. Upon full insertion of metallic pin 120 into locking receptacle 180, lock ring 150 after passing first tapered surface 136 constricts into engagement with first circumferential indent 128 in metallic pin 120. When engaged in first circumferential groove 128, an outer diameter of lock ring 150 is substantially greater than the diameter of central aperture 144 of lock structure 142, thus providing a primary metal-to-metal lock. Simultaneously, distal ends 164 of resilient fingers 162 pass second tapered surface 134 and engage shoulder 132 providing a second lock of metallic pin 120 within locking receptacle 180.

In the event of an attempt to remove locking receptacle 180 from locking pin 120, circumferential indent 128 carries lock ring upwardly against frusto-conical surface 146. Frusto-conical surface 146 forces lock ring 150 against first circumferential indent 128 and as a result of the external diameter of engaged lock ring 150 being greater than aperture 144 of lock structure 142, locking receptacle 180 is retained on metallic pin 120. Likewise, an attempted withdrawal of locking receptacle 180 is secondarily prevented by distal ends 164 of resilient fingers 162 bearing on shoulder 132 of second circumferential indent 130, since such an attempt would result in visually evident permanent deformation of the resilient fingers.

While mechanical security lock 100 provides substantial security to a shipping container, a kit including the security lock 100 and other related items can increase the integrity of the security seal.

Figure 1:
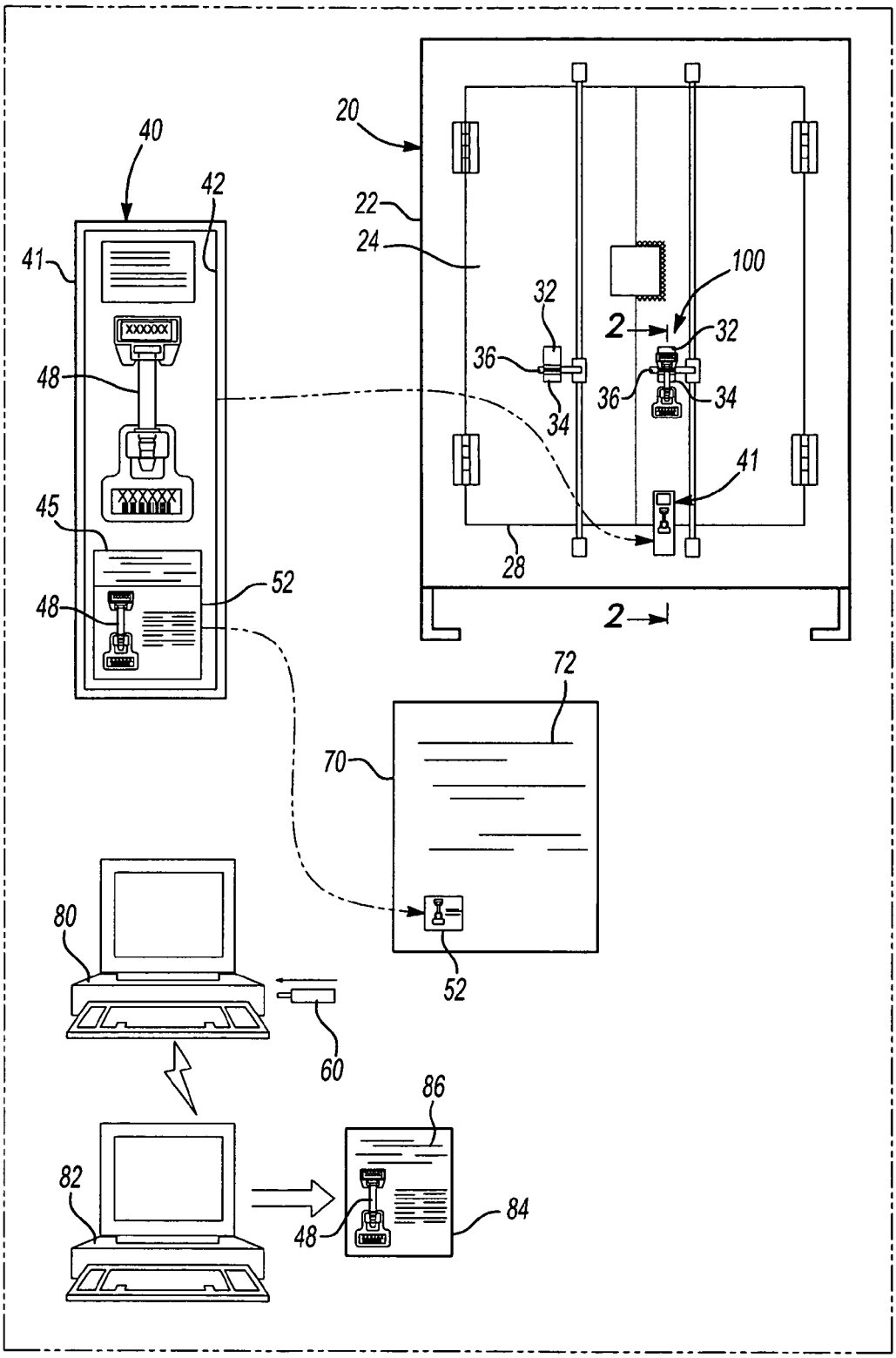
FIG. 1 is a general view of a layered sealing system for sealing a shipping container embodying the present invention, wherein a mechanical seal is installed on a shipping container and additional features are incorporated to insure the integrity of the seal.
Figure 2:
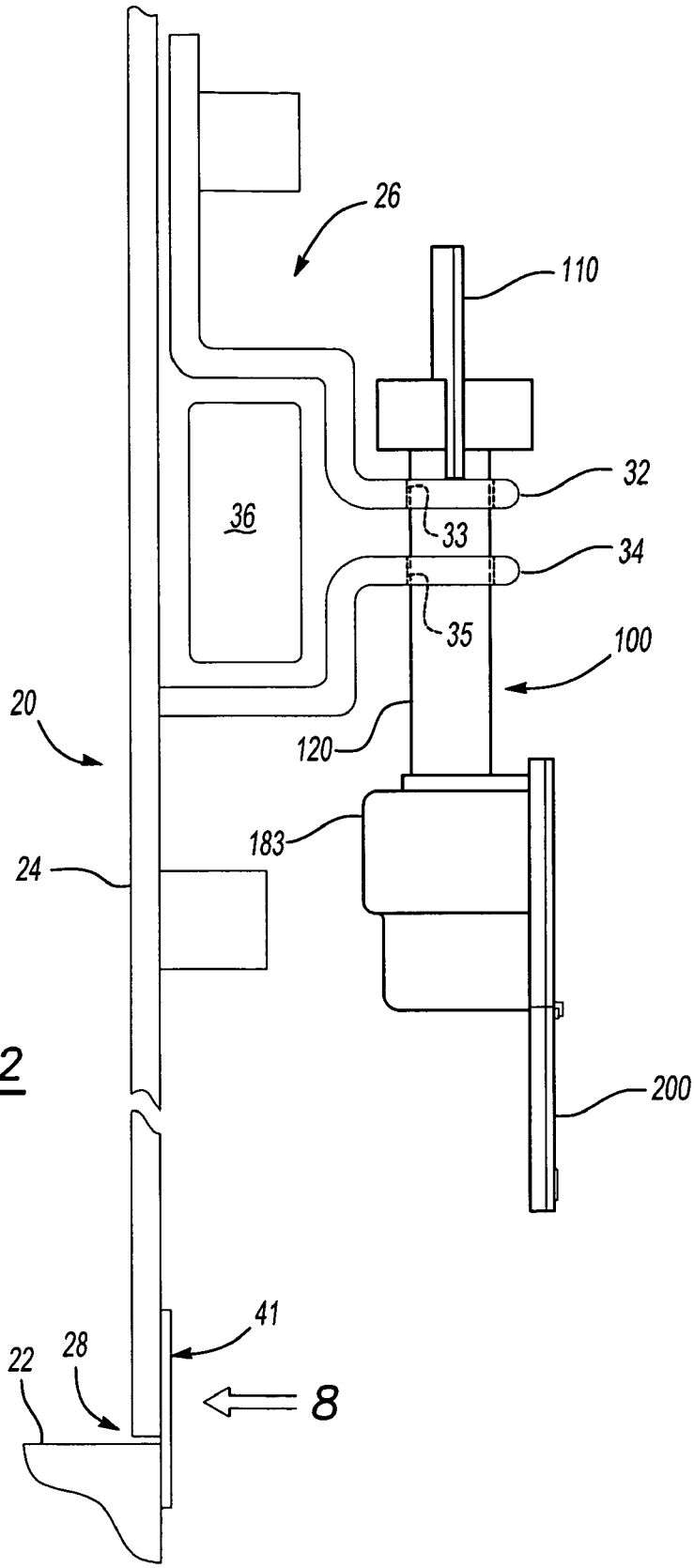
FIG. 2 is a side elevation view of a mechanical security seal installed on a shipping container.

FIG. 1 shows various interrelated elements of a kit for a layered approach to achieving a security seal on a shipping container 20 is another of the preferred embodiments of the present invention and illustrates its various components. A security sealing kit contains a metallic pin 120 having a head 122 encased in an upper banner 110 wherein the upper banner 110 includes unique indicia 114 formed thereon. For example, indicia 114 can be in the form of a unique serial number. Also provided in the kit is a locking receptacle 180 having a lower banner 200, in which is embedded in a visible manner unique indicia 204 in the form of the identical indicia 114 on upper banner 110, thereby providing a matched combination for installation on a shipping container 20.

Figure 8:
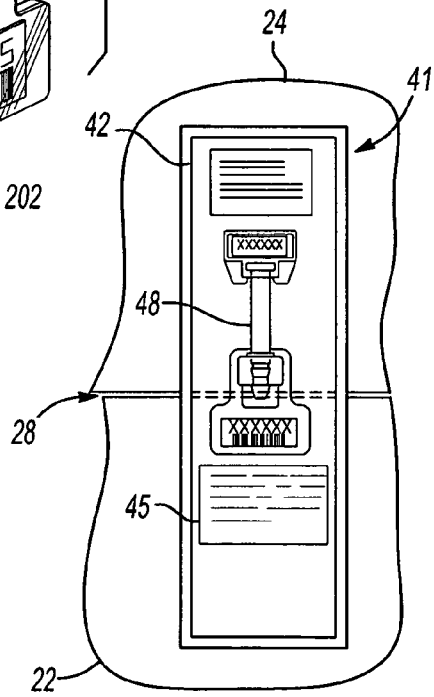
FIG. 8 is an elevation view of a sealing label affixed to the interface area of the door and frame of a shipping container indicated by arrow 8, FIG. 2.
Figure 9:
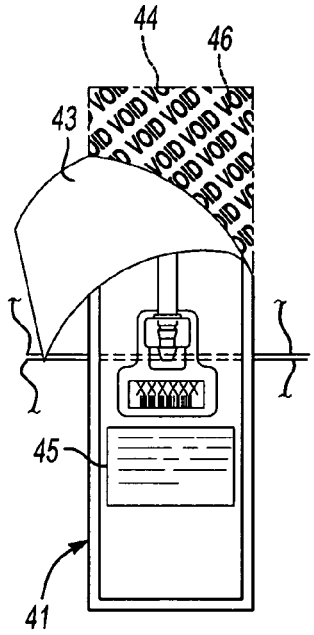
FIG. 9 is an elevation view of the after an attempt by an unauthorized person to peel the sealing label from the container revealing an anti-tampering feature of the label.

Also provided in the kit is a label 40. Label 40 comprises a sealing label 41 and an identification label 52 removably affixed to sealing label 41. Sealing label 41 (also see FIGS. 8 and 9) is comprised of a thin flexible substrate upon which is printed (e.g., laser printed) a visual depiction 48 of mechanical security seal 100. The mechanical security seal 100 visually depicted thereon includes the unique identifying indicia 114 and 204 shown in their respective locations on upper banner 110 and lower banner 200. Sealing label 41 also includes a data recording field upon which can be manually entered in indelible ink such information as date and time of sealing and the identification of the individual sealing the container 20. Sealing label 41 includes an inked border 42 wherein the border ink comprises solvent soluble ink. Although not shown, the border 42 preferably is in the form of a series of alternating colored rectangles or some other continuous pattern. In the event of an individual attempting to remove label 41 from a container 20 through the use of solvents, the inked border 42 would be visibly altered and present an indication of attempted tampering. The incorporation of a multi-colored repeated pattern functions to make the tampering even more evident. Additionally, slit lines or tear lines (not shown) may be provided at spaced apart intervals along the inked border 42 to cause visible tearing of the label during an attempted removal. Sealing label 41 can also have on a front thereof a unique message printed in infrared sensitive ink, which is normally invisible. Thus, as an added level of integrity for the sealing label 41, a light source emitting infrared light can be directed on security label 41 at which time the message becomes visible. Sealing label 41 includes an adhesive backing layer 44 for affixation to an adherend surface of the container 20. Adhesive backing layer 44 includes a tamper-evident message 46, such as the repeated word "VOID," included therein, such that an attempt to peel sealing label 41 off of the adherend surface results in the visible presence of the tamper-evident message 46.

Identification label 52, removable from label 40, includes visual depictions 48 of security seal 100. Identification label 52 also has an adhesive backing and can be permanently affixed to a shipping document 70 associated with the shipping container 20. The shipping document 70 includes shipping information 72 pertaining to the shipping container 20.

Also included in the kit is an electronic memory device 60, such as a USB flash memory stick, having stored thereon multiple Hyper Text Mark-Up Language (HTML) text files. Each HTML text file comprises a specific seal's security indicia. For example, a kit including sixty seals would include a memory device having sixty HTML text files. When a customer opens a particular file, it automatically links to a secure database (e.g., maintained by the seal manufacturer), where the indicia are superimposed over a graphical image of the seal in its manufactured state. This feature of the invention provides a significant crosschecking function. Namely, even in instances where there is tampering with the seal and label, such tampering will be evident to the customer during this crosscheck operation.

Referring now to FIGS. 1, 2, and 6-9, in use, the methodology for using a security sealing kit would comprise closing and latching a door 24 on a filled shipping container 20. Each shipping container 20 has a unique, non-repeated, serial number associated therewith for tracking of the shipment. Latch 26 securing door 24 in a closed position includes first and second latch members 32 and 34 having vertically aligned openings 33 and 35 therein for receiving a lock. The alignment of latch members 32 and 34 cooperate to secure a latch bar 36 in a closed position, preventing the opening of door 24. Depending upon the individual container 20, the particular configuration of latch 26 may differ from container 20 to container 20. Stem 124 of metallic pin 120 is inserted through openings 33 and 35 and locking receptacle is then lockingly engaged with metallic pin 120 in the manner described above to mechanically secure container door 24 in a closed state. Any attempt to remove mechanical seal 100 will result in the activation of one or more of the tamper evident features of mechanical security seal 100 described above.

Identification label 52 is removed from label 40 and applied to a shipping document that has included thereon a unique serial number of the container 20 thereby associating the serial number of the mechanical locking seal with the serial number of the container 20.

Security label 41 is affixed to container 20 by adhering adhesive layer 44 to an adherend surface of container 20. The adherend surface can be the interface area 28 of an edge of door 24 and frame 22 (FIGS. 1, 8, and 9) or another area where opening of door 24 would cause the fracturing or tearing of security label 41. Any attempt at peeling security label 41 from the adherend surface results in the tearing of substrate layer 43 and in the display of the tamper-evident message 46. The person sealing container 20 can enter, in data recording field 45, sealing information such as the time and date the container was sealed along with an identifying mark of the person sealing the container 20.

Finally, the shipper or the individual sealing container 20 electronically connects memory device 60 to a data processing device 80 such as a computer. The pre-recorded digital file containing the visual depiction 48 of mechanical seal 100 associated with the container is accessed and attached or inserted in another digital file including the serial number of the associated container 20. The digital file containing the visual depiction 48 and the container serial number could, for instance, be an e-mail that is subsequently electronically transmitted via a network such as the World Wide Web, to the destination of the container and all other associated parties (e.g., boarder control). Upon receipt of the container, the mechanical security seal 100 and the security label 41 can be inspected for evidence of tampering and the mechanical security seal 100 can be visually compared to the visual depictions 48 on security label 100, the shipping document, and the electronically transmitted file.

In the foregoing description those skilled in the art will readily appreciate that modifications may be made to the invention without departing from the concepts disclosed herein. Such modifications are to be considered as included in the following claims, unless these claims expressly state otherwise.

What is claimed is:

1. A tampering and data security kit for a shipping container door and shipment, said kit comprising:

a mechanical security seal for sealingly secure said container door, said security seal including a metallic pin and a lock receptacle for receiving said pin, said seal further including an unalterable visible unique identifier;

a tamper proof adhesive label including at least one tamper-evident feature and including a visual depiction of said mechanical security seal printed thereon to associate said tampering proof adhesive label to said mechanical security seal, said visual depiction including said unique identifier, wherein said sealing security adhesive label is provided for attachment to the shipping container door such that the sealing security adhesive label spans an opening between the shipping container door and an adjacent surface which would cause at least one of fracturing and tearing of the tamper proof security adhesive label when the door is opened;

an identification adhesive label including a visual depiction of said mechanical security seal printed thereon, said visual depiction including said unique identifier, wherein said identification adhesive label is provided for attachment to a shipping document associated with the shipment being protected by the mechanical security seal;

said association between said security seal, said tamper proof label and said identification label provides the user proof of unauthorized tampering of the shipping container door and contents of the container; and wherein said visual depiction and said unique identifier can be stored as a digital image file using an electronic memory device electronically connected with a data processing device.

2. The kit according to kit according to claim 1 wherein the tamper proof adhesive label further comprises a border, and a solvent soluble ink disposed upon at least a portion of said border to create an inked image as a tamper-evident feature.

3. The kit according to kit according to claim 1 wherein the tamper proof adhesive label further comprises an ink visible only upon illumination with a light radiating in the infra-red spectrum as a tamper-evident feature, wherein said ink is applied in the format of a message printed on the tamper proof adhesive label.

4. The kit according to kit according to claim 2 wherein the tamper proof adhesive label further comprises:

a thin flexible substrate receiving said visual depictions and said printings on a front surface thereof; and an adhesive layer applied to a back surface of said thin flexible substrate, said adhesive layer including a tamper-evident message that remains visible when said sealing security adhesive label is affixed to an adhered surface and said substrate layer is subsequently peeled away.

5. The kit according to kit according to claim 1 wherein the tamper proof adhesive label further comprises:

a thin flexible substrate receiving printings and said visual depictions on a front surface thereof; and an adhesive layer applied to a back surface of said thin flexible substrate, said adhesive layer including a tamper-evident message that remains visible when said sealing security adhesive label is affixed to an adhered surface and said substrate layer is subsequently peeled away.

6. The kit according to kit according to claim 1 wherein said identification adhesive label is detachably affixed to the tamper proof adhesive label.

7. A kit as recited in claim 1, wherein said metallic pin has a head at an upper end non-removably encased in an upper banner, said upper banner further having first identifying indicia formed thereon, said indicia unique to a particular one of a plurality of like mechanical seals, said metallic pin having a plurality of circumferential indents at a second end;

where said lock receptacle receives said second end of said metallic pin therein, said lock receptacle including a lock housing retaining at least two locks therein, a first of said locks for non-removable engagement of a first of said circumferential indents and a second of said locks for non-removable engagement of a second of said circumferential indents, said lock receptacle further including a substantially transparent lower banner extending therefrom and having embedded therein a second identifying indicia identical to said first identifying indicia on said upper banner.

8. The kit according to kit according to claim 7 wherein a first of said locks in said mechanical security seal comprises a lock structure retained in said lock receptacle, said lock structure having an aperture therethrough defined by a cannular surface therein for receiving said second end of said metallic pin, said aperture marginally larger than a diameter of said metallic pin, said cannular surface further defining a circumferential recess therein, said circumferential recess having an upper frusto-conical surface such that a lower diameter of said frusto-conical surface is greater than an upper diameter thereof, and a radially expansive lock ring disposed in said circumferential recess and having a relaxed diameter less than said metallic pin diameter, said lock ring for engagement in one of said metallic pin circumferential indents when said metallic pin is received in said lock receptacle such that an outer diameter of said lock ring engaged in said metallic pin circumferential indent is greater than said aperture diameter.

9. The kit according to kit according to claim 7 wherein said second identifying indicia in said lower banner further includes a machine readable bar code.

10. The kit according to kit according to claim 9 wherein said lock housing and said lower banner are fabricated of a substantially transparent thermoplastic material and said second identifying indicia is encapsulated within said transparent thermoplastic.

11. The kit according to kit according to claim 7 wherein said upper banner further includes at least one tamper-evident fin extending below said head of said metallic pin.

12. A method of security sealing and tamper-proofing a container for shipping, said method comprising the steps of: associating a uniquely identified mechanical security seal with a uniquely identified container; inserting a mechanical security seal metallic pin having an upper banner with a unique identifying indicia formed thereon through a pair of aligned openings adapted to receive a lock on a door closure structure of the container such that the door cannot be opened without removing the metallic pin; sleeving a locking receptacle having a plurality of locks therein and a lower banner with an identical identifying indicia over the metallic pin until all locks engage the metallic pin; adhesively applying a tamper proof adhesive label to an area of a door-frame interface area of the container such that opening the door will fracture the tamper proof adhesive label, the tamper proof adhesive label including at least one tamper-evident feature and further including a visual depiction of the mechanical security seal printed thereon wherein the visual depiction includes the unique identifying indicia; adhesively applying an identification adhesive label to a shipping document separate from the container wherein the shipping document includes the unique identifier of the container and the identification adhesive label includes a visual depiction of the mechanical security seal printed thereon wherein the visual depiction also includes the unique identifying indicia, wherein an association between said security seal, said tamper proof label and said identification label provides the user proof of unauthorized tampering of the shipping container door and contents of the container.

13. The method according to claim 12 further comprising after said adhesively applying the identification adhesive label step, the steps of:

connecting an electronic memory device to a data processing device wherein the electronic memory device has a pre-stored digital HTML text file corresponding to the unique identifying indicia of said mechanical security seal;

electronically communicating said HTML text file to a remote computer database having stored thereon a digital image visually depicting the mechanical seal associated with said unique identifying indicia;

digitally combining the text file and the digital image of the mechanical seal; and electronically transmitting the digitally combined text and image files to the destination of the container.

14. The method according to claim 13 further comprising, after the step of electronically transmitting, the steps of:

inspecting the integrity of the mechanical security seal at the container destination;

inspecting the integrity of the tamper proof adhesive label at the container destination; and comparing the mechanical security seal affixed to the container with the visual representation of the mechanical security seal on the tamper proof adhesive label, the visual representation of the mechanical security seal on the identification adhesive label on the shipping document, and the visual representation on the electronically transmitted digital identification file at the container destination.

15. A tampering and data security kit for a shipping container door and shipment, said kit comprising:

a mechanical security seal for sealingly secure said container door, said security seal including a metallic pin and a lock receptacle for receiving said pin, said seal further including an unalterable visible unique identifier;

a tamper proof adhesive label including at least one tamper-evident feature and including a visual depiction of said mechanical security seal printed thereon to associate said tampering proof adhesive label to said mechanical security seal, said visual depiction including said unique identifier, wherein said sealing security adhesive label is provided for attachment to the shipping container door such that the sealing security adhesive label spans an opening between the shipping container door and an adjacent surface which would cause at least one of fracturing and tearing of the tamper proof security adhesive label when the door is opened;

an identification adhesive label including a visual depiction of said mechanical security seal printed thereon, said visual depiction including said unique identifier, wherein said identification adhesive label is provided for attachment to a shipping document associated with the shipment being protected by the mechanical security seal;

said association between said security seal, said tamper proof label and said identification label provides the user proof of unauthorized tampering of the shipping container door and contents of the container.

16. The kit according to kit according to claim 15 wherein the tamper proof adhesive label further comprises a border, and a solvent soluble ink disposed upon at least a portion of said border to create an inked image as a tamper-evident feature.

17. The kit according to kit according to claim 15 wherein the tamper proof adhesive label further comprises an ink visible only upon illumination with a light radiating in the infra-red spectrum as a tamper-evident feature, wherein said ink is applied in the format of a message printed on the tamper proof adhesive label.

18. The kit according to kit according to claim 17 wherein the tamper proof adhesive label further comprises:

a thin flexible substrate receiving said visual depictions and said printings on a front surface thereof; and an adhesive layer applied to a back surface of said thin flexible substrate, said adhesive layer including a tamper-evident message that remains visible when the tamper proof adhesive label is affixed to an adhered surface and said substrate layer is subsequently peeled away.

19. The kit according to kit according to claim 15 wherein the tamper proof adhesive label further comprises:

a thin flexible substrate receiving printings and said visual depictions on a front surface thereof; and an adhesive layer applied to a back surface of said thin flexible substrate, said adhesive layer including a tamper-evident message that remains visible when the tamper proof adhesive label is affixed to an adhered surface and said substrate layer is subsequently peeled away.

20. The kit according to kit according to claim 15 wherein said identification adhesive label is detachably affixed to the tamper proof adhesive label.

21. A kit as recited in claim 15, wherein said metallic pin has a head at an upper end non-removably encased in an upper banner, said upper banner further having first identifying indicia formed thereon, said indicia unique to a particular one of a plurality of like mechanical seals, said metallic pin having a plurality of circumferential indents at a second end;

where said lock receptacle receives said second end of said metallic pin therein, said lock receptacle including a lock housing retaining at least two locks therein, a first of said locks for non-removable engagement of a first of said circumferential indents and a second of said locks for non-removable engagement of a second of said circumferential indents, said lock receptacle further including a substantially transparent lower banner extending therefrom and having embedded therein a second identifying indicia identical to said first identifying indicia on said upper banner.

22. The kit according to kit according to claim 21 wherein a first of said locks in said mechanical security seal comprises a lock structure retained in said lock receptacle, said lock structure having an aperture therethrough defined by a cannular surface therein for receiving said second end of said metallic pin, said aperture marginally larger than a diameter of said metallic pin, said cannular surface further defining a circumferential recess therein, said circumferential recess having an upper frusto-conical surface such that a lower diameter of said frusto-conical surface is greater than an upper diameter thereof, and a radially expansive lock ring disposed in said circumferential recess and having a relaxed diameter less than said metallic pin diameter, said lock ring for engagement in one of said metallic pin circumferential indents when said metallic pin is received in said lock receptacle such that an outer diameter of said lock ring engaged in said metallic pin circumferential indent is greater than said aperture diameter.

23. The kit according to kit according to claim 21 wherein said second identifying indicia in said lower banner further includes a machine readable bar code.

24. The kit according to kit according to claim 23 wherein said lock housing and said lower banner are fabricated of a substantially transparent thermoplastic material and said second identifying indicia is encapsulated within said transparent thermoplastic.

25. The kit according to kit according to claim 21 wherein said upper banner further includes at least one tamper-evident fin extending below said head of said metallic pin.

* * * * *